US006393702B1

(12) United States Patent
Laube

(10) Patent No.: US 6,393,702 B1
(45) Date of Patent: May 28, 2002

(54) DISPOSABLE CUTTING HEAD FOR CLIPPERS

(76) Inventor: Kim Laube, 537 Calle Yucca, Thousand Oaks, CA (US) 91360-2583

( * ) Notice: Subject to any disclaimer, the term of this patent is extended or adjusted under 35 U.S.C. 154(b) by 0 days.

(21) Appl. No.: 09/610,645

(22) Filed: Jun. 27, 2000

Related U.S. Application Data

(63) Continuation-in-part of application No. 09/457,454, filed on Dec. 8, 1999, which is a continuation of application No. 09/222,049, filed on Dec. 29, 1998, now abandoned.

(51) Int. Cl.[7] ..... B26B 19/04
(52) U.S. Cl. ..... 30/223; 30/225
(58) Field of Search ..... 30/210, 216, 223, 30/225, 43.92, 346.51

(56) References Cited

U.S. PATENT DOCUMENTS 4,328,616 A * 5/1982 Andis ..... 30/216 X

* cited by examiner

*Primary Examiner*—Douglas D. Watts
(74) *Attorney, Agent, or Firm*—Dennis W. Beech

(57) ABSTRACT

The disposable cutting head is basically a four element clip together assembly with a base, lower and upper cutting blades, and spring. The base serves as the support for the entire assembly and incorporates the attachment elements for retention to a clipper. The spring holds the elements together, forces the cutting blades together and includes the runner under which the upper blade slides. The entire assembly is such that the head assembly with blades is of the disposable type, but uses metal blades. If desired the blades alone may be disposed and the head assembly reused; however, the structure is not intended for long wear and use. The head and blades are constructed such that the common problems encountered with existing removable/disposable heads and blades as for example heat retention in the blades and head and the catching and pulling of hair are minimized. Use with clipper comb elements is also accommodated.

26 Claims, 8 Drawing Sheets

DISPOSABLE CUTTING HEAD FOR CLIPPERS

This is a continuation-in-part of application Ser. No. 09/457,454 filed Dec. 8, 1999 which is a continuation of Ser. No. 09/222,049 filed Dec. 29, 1998 now abandoned. Application Ser. No. 09/457,454 is.

BACKGROUND OF THE INVENTION

1. Field of the Invention

This invention relates to devices used to clip or cut hair, fur and the like of humans and animals. The new device provides for a disposable cutting head including blades to simplify in an economical maintenance of a relatively sharp cutting instrument.

2. Description of Related Art

There are currently in use a variety of devices for clipping, cutting and shearing hair and fur. These include devices commonly known as hair clippers or just clippers which in most instances modernly are powered by electric motors. Clippers as originally conceived and developed include cutting blades which are intended to be removed from the head of a clipper and sharpened to maintain the clipper device cutting performance. Such blades may be attached to the clipper head by screws and the like or may have clips, clamps or other retention means for attachment to the clipper.

More modernly clippers have incorporated heads which are designed to include replaceable blades which blades are not intended to be continually sharpened, but rather to be removed and disposed. U.S. Pat. No. 2,722,742, issued Nov. 8, 1955 is an example of such a device. Also, clipper head assemblies which are disposable have been designed for use with clippers. An example of a plastic disposable head assembly for clippers is disclosed in U.S. Pat. No. 4,563,814, issued Jan.14, 1986.

The present invention provides an improved structure for a clipper head assembly with disposable blades. The entire assembly is such that the head assembly with blades is of the disposable type, but uses metal blades. If desired, the blades alone may be disposed and the head assembly reused; however, the structure is not intended for long wear and use. The head and blades are constructed such that the common problems encountered with existing removable/disposable heads and blades as for example heat retention in the blades and head and the catching and pulling of hair are minimized.

The support front edge of the base member of the present invention has no structure, such as comb teeth, which are under any portion of the cutting blades which comb teeth can catch and pull hair as, for example, in the U.S. Pat. No. 4,328,616, issued May 11, 1982 which has comb teeth under the cutting blade teeth such that when the two tooth elements are not in contact hair will be caught and pulled. In addition both cutting blades of the instant invention have a slightly concave shape, one relative to the other, along the entire blade longitudinal dimension to counter the tendency for blades to curl and separate which could cause the catching and pulling of hair as well as other problems. U.S. Pat. No. 4,765,060, issued Aug. 23, 1988 discloses a bend in the blade ends which may cause problems of separation as a result of a lack of a continuous concave shape along the longitudinal axis.

The cutting blades of the instant invention have indentations in the teeth to minimize heat build up and provide structural strength for the teeth. This is accomplished without the need for cut outs in the tooth edge wall which is done for example in sheep cutting clipper blades to provide flexibility. Such cut outs can cause loss of lubricants and also serve as a point that may catch and pull hair. In general, the new structure thus provides better cutting efficiency and minimum heat transfer to the subject being trimmed. The a disposable system achieves improved performance in cutting efficiency and is constructed to be used with existing comb snap on devices.

SUMMARY OF THE INVENTION

One object of the present invention is an improved cutting head structure for clippers which lowers friction and improves heat dissipation of the combination cutting head and blades to allow for a disposable clipper cutting head assembly. Another object is to reduce warpage of the head and/or blades during use in cutting to minimize hair pulling caused by hair becoming caught between the cutting blades rather than being cleanly cut. A further object is a disposable head and blade design which may be used with existing clip on combs. Another object is adaption of the cutting head for use with spring lock comb elements. A still further object is an upper cutting blade shoe structure for reduced friction wear of a clipper drive lug, which is usually plastic material, to which the upper blade shoe is engaged during clipper reciprocal drive operation. Another object is shielding of the clipper cavity which receives the cutting head to reduce the amount of hair or fur entering therein during a cutting operation. Yet another object is incorporation of protrusions in the base member to accommodate a variety of size of clipper blade socket mounting apparatus.

In accordance with the description presented herein, other objectives of this invention will become apparent when the description and drawings are reviewed.

DESCRIPTION OF THE PREFERRED EMBODIMENT

Figure 1:
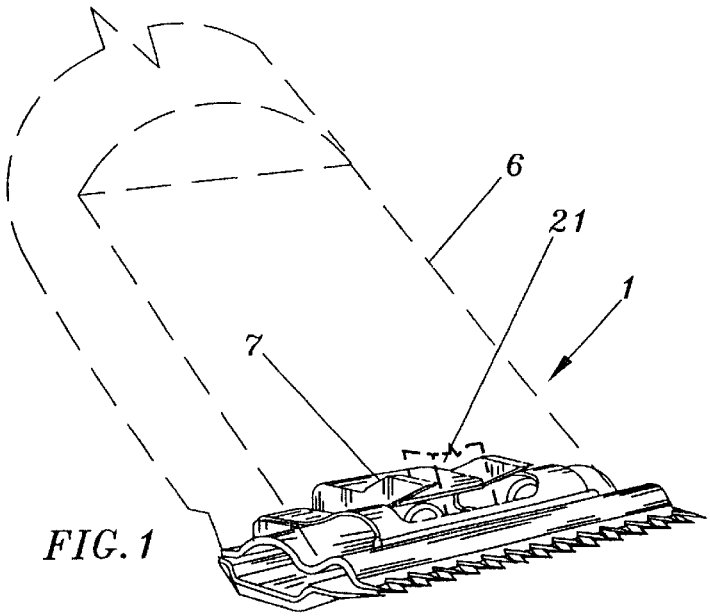
FIG. 1 illustrates a perspective view of the head assembly with blades and outline of clipper.

The disposable cutting head is basically a four element clip together assembly with a base, lower and upper cutting blades, and spring. The base serves as the support for the entire assembly and incorporates the attachment elements for retention to a clipper. The spring holds the elements together, forces the cutting blades together and includes the runner under which the upper blade slides. Attachment of a comb element may also be included. Alternate embodiments are described which use screw retention means for the spring and which use a spring lock for retention of comb elements. A plastic comb element for use with the spring lock retention means is incorporated. A deflector plate may be added to the spring structure to inhibit hair entering the clipper cavity.

Referring to FIGS. 1 through 15, disposable cutting head (1) has base member (2) having a rear mounting portion (3) and lower blade support portion (4). The rear mounting portion (3) has an upstanding central bridge (5) with clipper (6) attachment lugs (7). The lower blade support portion (4) has posts (8) to retain lower cutting blade (9). The lower blade support portion (4) support front edge (37) does not extend such that it protrudes under the lower cutting blade (9) lower teeth (13). This alleviates the problem with existing cutting heads wherein the blade support element tends to catch and pull hair on the support base during cutting.

The lower cutting blade (9) is placed in lower blade support portion (4) with apertures (14) receiving posts (8). The posts (8) inhibit horizontal motion of the lower cutting blade (9) relative to the lower blade support portion (4) yet allow vertical motion of the lower cutting blade (9). This provides for a vertical "floating" condition to maintain contact with the upper cutting blade (15) under conditions as for example when heating causes a blade to curl or warp. The posts (8) and apertures (14) also allow ease of blade replacement if such is desired and do not flatten the concave curvature of the blade as when fixed in place by permanent attachment in other cutting heads.

Lower cutting blade (9) has a generally planar rectangular shape with a recessed portion (10) the longitudinal length of the blade. There are ribs (11) formed in the recessed portion (10) to provide structural strength and to aid in minimizing heat build up. The lower cutting blade (9) also has indentations (12) or creases formed in the lower teeth (13) to reduce the sliding friction surface to minimize heat build up, to allow coolant flow and to provide structural strength.

The lower cutting blade (9) is placed in lower blade support portion (4) with apertures (14) receiving posts (8). Upper cutting blade (15) is placed in sliding relationship on lower cutting blade (9) with lower teeth (13) parallel to upper teeth (16). In operation the upper cutting blade (15) slides longitudinally relative to the fixed lower cutting blade (9).

Figure 2:
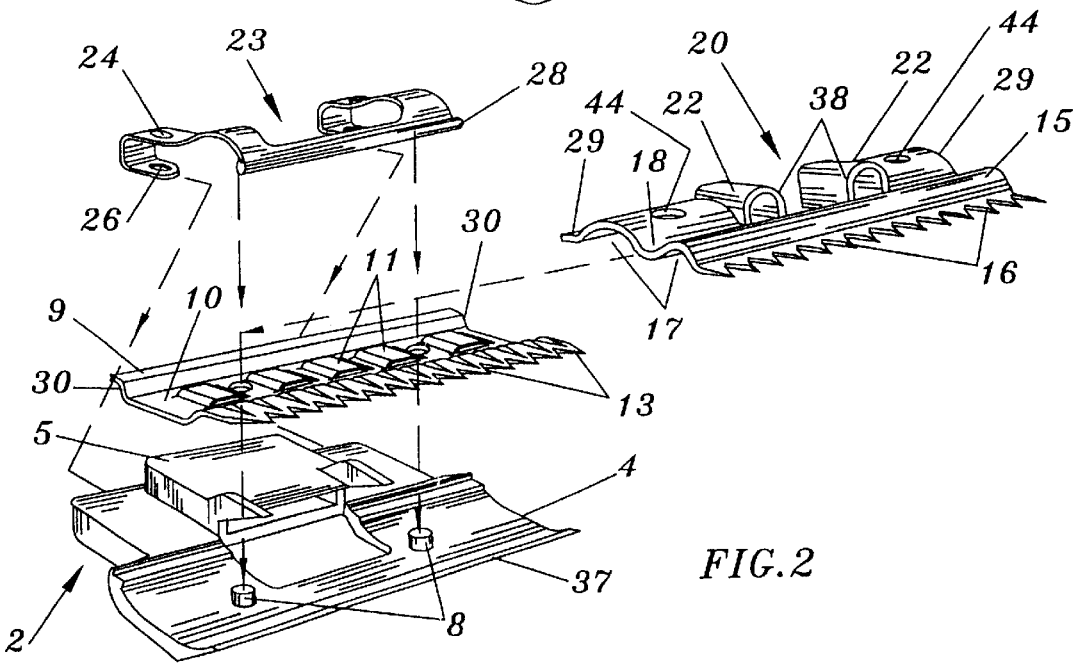
FIG. 2 illustrates a perspective view, exploded, of the head assembly and blades.

Upper cutting blade (15) is a generally planar rectangular shape with a recessed portion (17) formed along the longitudinal length of the blade which as illustrated in FIG. 2 may be formed in a stamping operation to be of upwardly arched geometry in the lateral dimension. There are a plurality of upper teeth (16) forming the forward portion which may have indentations (12) similar to lower teeth (13). There is a groove (18) parallel with and spaced from the front toothed edge.

Figure 5A:
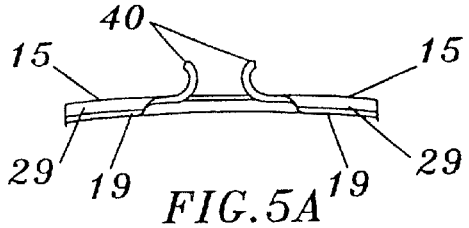
FIG. 5A illustrates an elevation edge view of an alternate embodiment of the upper cutting blade.
Figure 15:
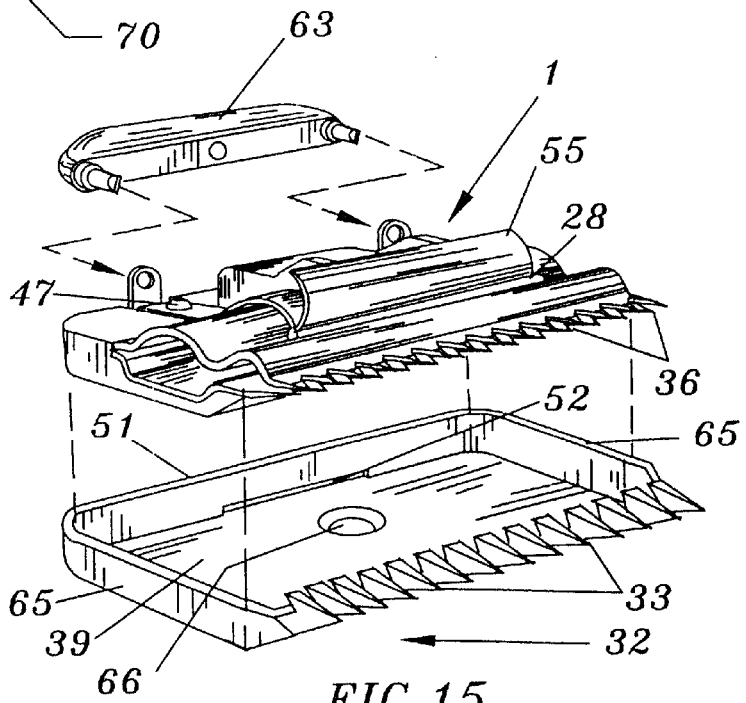
FIG. 15 illustrates a perspective view of the head assembly with blades attachable to an alternate tooth comb mounting apparatus.
Figure 6A:
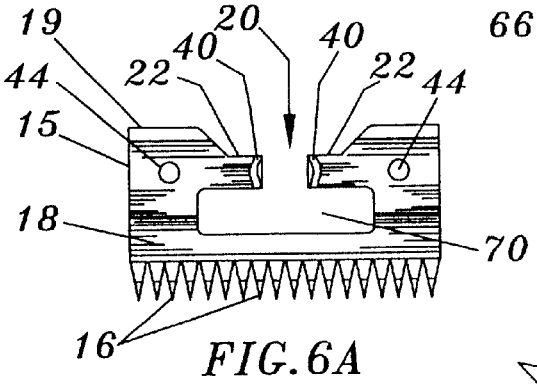
FIG. 6A illustrates a top plan view of the upper cutting blade with shoe lugs.
Figure 17:
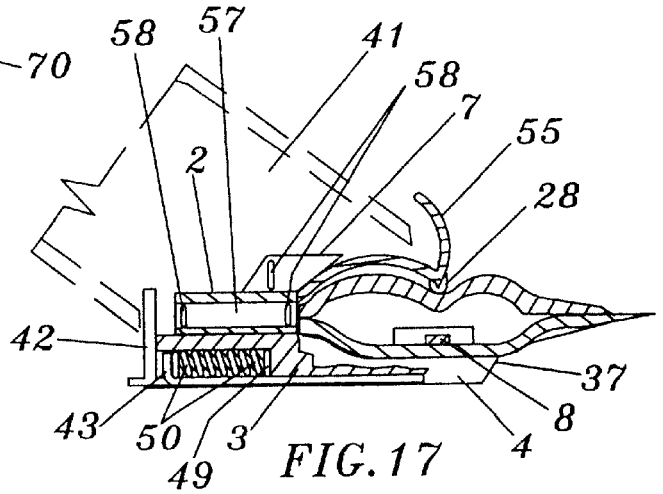
FIG. 17 illustrates a side elevation cross-section view of an alternate embodiment of the head assembly with blades and spring mounting apparatus.

The rear edge (19) of the upper cutting blade (15) contains an enlarged recess (20) adapted to receive a drive lug (21) or other drive element of a clipper (6). There are a pair of shoes (22) formed in enlarged recess (20) to reduce friction wear caused by the reciprocal operation of clipper drive lug (21) operating to move upper cutting blade (15) in a sliding reciprocating motion across lower cutting blade (9). The shoes (22) preferably have rounded edges (38) to reduce wear of the drive lug (21). However, a suitable curved shoe lug (40) as illustrated in FIG. 5A may also be used.

The spring member (23) is generally a U-shape element of spring steel or the like having opposed arms (24) shaped to fit the back edge (25) of the mounting portion (3) of base member (2). The opposed arms (24) may be retained on the base member (2) by arm apertures (26) engaging attachment posts (27). The opposing arms (24) curve upwardly from the base member (2) and project forward in an arched manner over the upper cutting blade (15) to terminate in a downwardly manner presenting a transverse, elongated runner (28) to engage the upper cutting blade (15) groove (18). The runner (28) would preferably have a plastic coating, sleeve or the like surface for ease in sliding motion with the groove (18).

Figures 3, 3A, 12A:
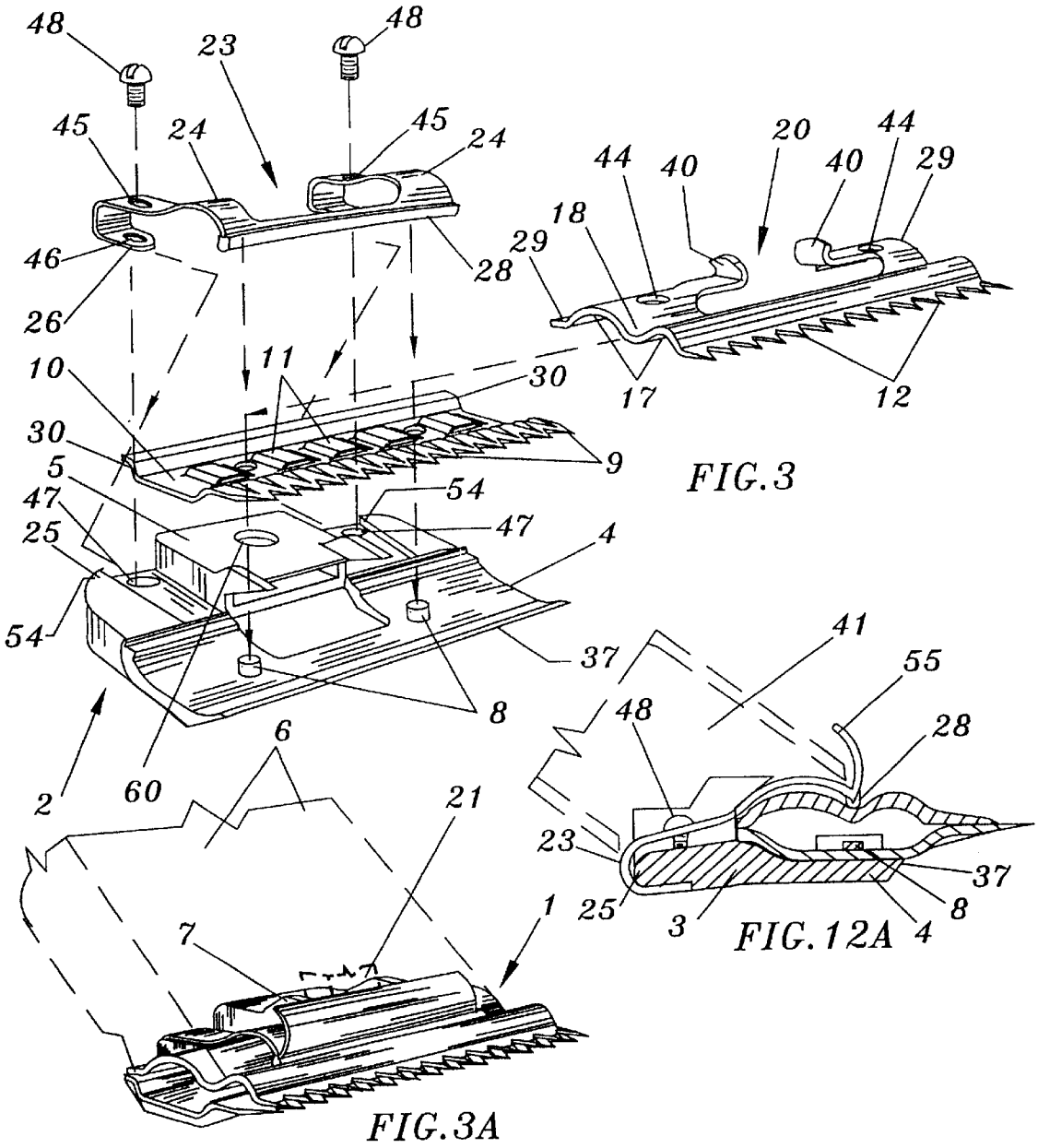
FIG. 3 illustrates a perspective view, exploded, of an alternate embodiment of the head assembly and blades.
FIG. 3A illustrates a perspective view of an alternate embodiment of the head assembly with a deflector plate.
FIG. 12A illustrates a side elevation cross section view of the head assembly with blades and a spring member with a deflector plate.

The spring member (23) may also be retained on the base member (2) by a thread attachment method. An example is illustrated in FIG. 3 wherein posts (27) are replaced with apertures (47) and the arm apertures (26) are threaded apertures (46) to receive screws (48). In addition, apertures (45) are included to allow the screws to pass through the opposed arms (24) upper portion. The threading of the screws (48) into the spring member (23) provides a means to adjust the tightness by which the spring member (23) is removably attached. Thereby the tension may be loosened when cutting fine or loose hair to reduce blade wear due to friction and heat; yet the tension may be increased when thick or matted hair to be cut.

The spring member (23) may also have an extended plate element or deflector plate (55) as best illustrated in FIGS. 3A and 12A to inhibit entry of hair or fur into the clipper cavity (41) during cutting operation.

Figure 4:
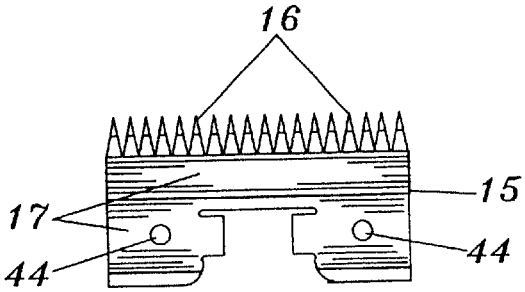
FIG. 4 illustrates a bottom plan view of the upper cutting blade.
Figure 5:
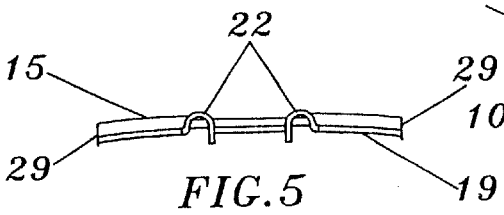
FIG. 5 illustrates an elevation edge view of the upper cutting blade.
Figure 8:
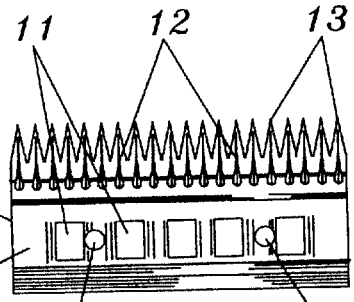
FIG. 8 illustrates a bottom plan view of the lower cutting blade.
Figure 9:
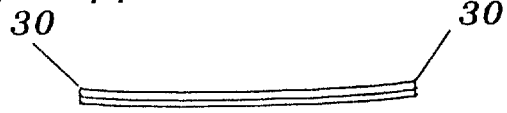
FIG. 9 illustrates an elevation edge view of the lower cutting blade.
Figure 6:
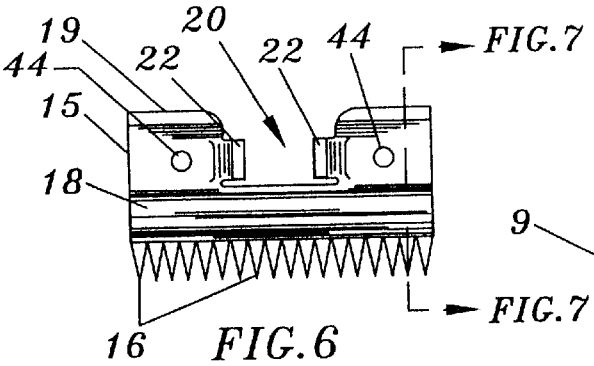
FIG. 6 illustrates a top plan view of the upper cutting blade.
Figure 10:
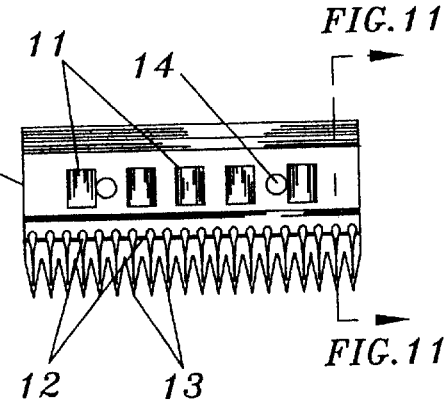
FIG. 10 illustrates a top plan view of the lower cutting blade.
Figure 7:
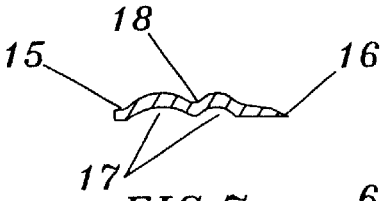
FIG. 7 illustrates a side elevation cross—section view of the upper cutting blade taken at line 6—6.
Figure 11:
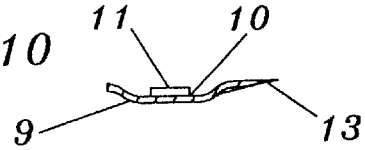
FIG. 11 illustrates a side elevation cross-section view of the lower cutting blade taken at line 10—10.
Figure 12:
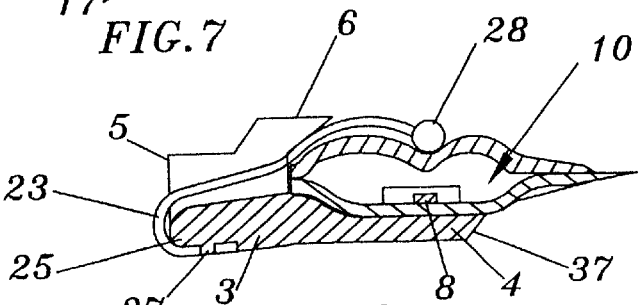
FIG. 12 illustrates a side elevation cross-section view of the head assembly with blades.
Figure 4A:
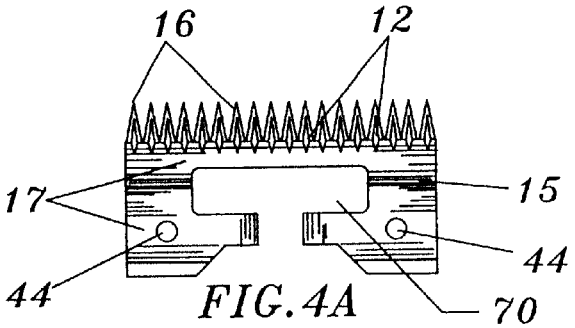
FIG. 4A illustrates a bottom plan view of an alternate embodiment of the upper cutting blade.

In the preferred embodiment the lower cutting blade (9) and the upper cutting blade (15) are formed with a slightly concave shape along their longitudinal dimension one to the other in a plane parallel to the rows of cutting teeth (13, 16) as in FIGS. 4 and 8. This serves to counter the tendency of cutting blades to curl and partially separate from each other from the ends (29, 30) inward when there is heat build up due to sliding friction during use. This warping can occur both in manufacture and during use. The upper cutting blade (15) may be further modified by forming a generally rectangular opening to serve as a heat aperture (70) to further facilitate heat dissipation.

The blades (9, 15) may be press, cut and/or punched in manufacture. When manufactured there is a ragged edge on the side of the blade exiting the cutting tool. For the preferred embodiment the ragged mating edges are at the top edge, that is, the edge between blades. Thus the blades need only be machined smooth on the mating edges and the jagged edges remain to aid in, cutting hair, but do not touch the subjects skin to cause injury. To aid in attaching the upper cutting blade (15) to the fixturing for manufacture, fixturing holes (44) may be provided.

Figure 13:
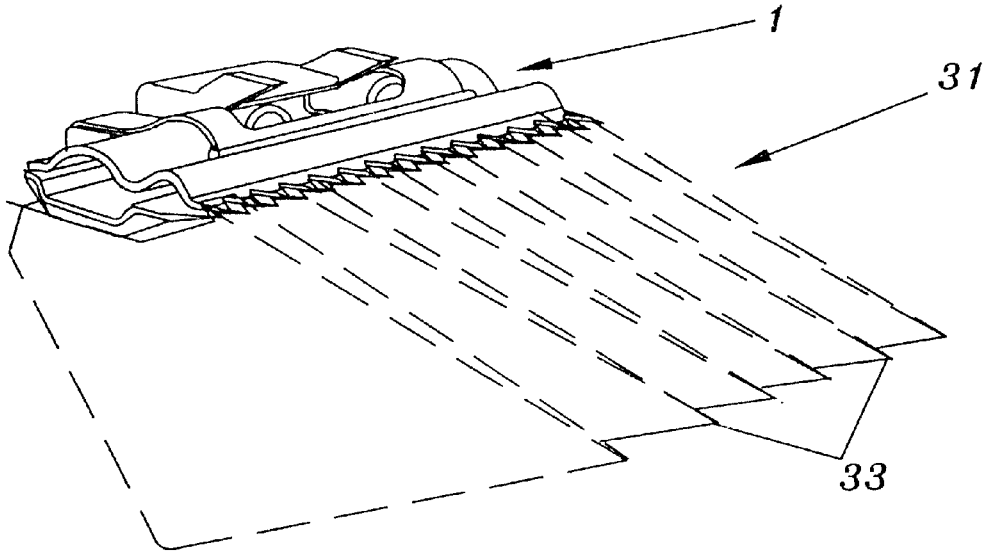
FIG. 13 illustrates a perspective view of the head assembly with blades and outline of an attached large tooth comb.
Figure 14:
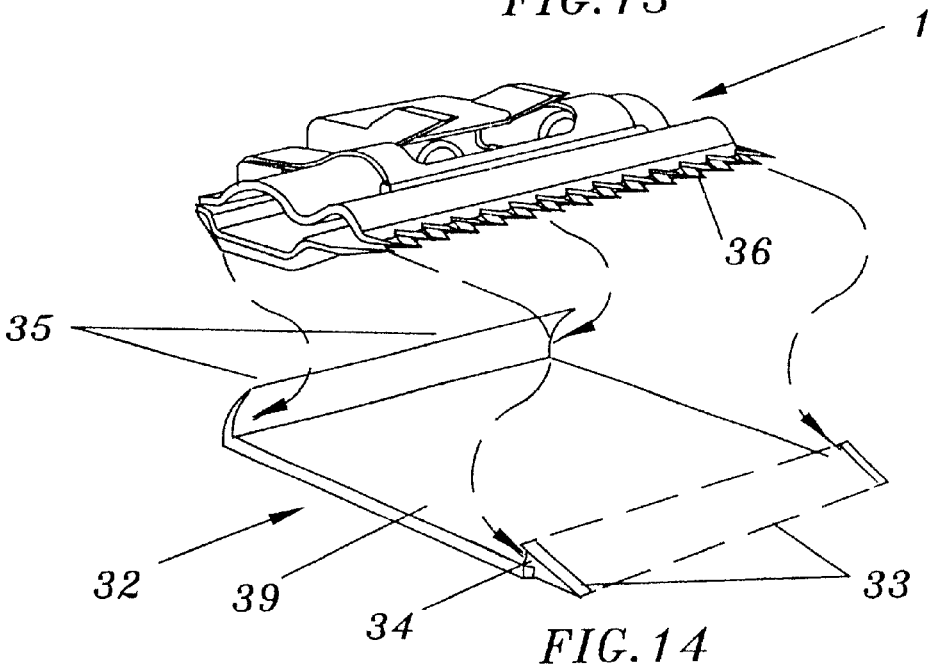
FIG. 14 illustrates a perspective view of the head assembly with blades attachable to a modified tooth comb mounting apparatus.

Referring to FIG. 13, a disposable cutting head (1) has attached a large tooth comb (31). The compact shape and the back-to-front width or lateral dimension of the assembly approximate more standard clipper heads and blades to allow attachment of standard comb attachments. Where a relatively flat comb attachment is desired, a metal or other strong structural material may be used as compared to the typical plastic comb (31). FIG. 14 illustrates an example of a thin comb element (32) with comb teeth (33) having groove notch (34) to receive the front edge (36) of the disposable cutting head (1) and spring clip (35) back edge to engage and retain the thin comb element (32). Either the plastic comb (31) or thin comb element (32) may include one or more mounting tabs (76) under which the base member (2) support front edge (37) may be placed when attaching a comb (31,32). Mounting notches (75) may be formed in the support front edge (37) to mate with the mounting tabs (76). The comb teeth (33) may include a tooth ridge element (78) attached to the tooth front edge (77). This reduces flatness of the comb teeth (33) at the front edge which is experienced in the manufacturing molding process. The tooth ridge element (77) aids in guiding the hair to be cut between the comb teeth (33).

The tooth comb (31), comb element (32) and comb teeth (33) may be coated with a low friction substance, as for example, that sold under the tradename TEFLON, vacuum deposited aluminum with a lacquer coating and the like coatings and sealers. The comb (31), comb element (32) and comb teeth (33) may be formed of metallic and silica additives in plastic for added strength of material as compared to plastic combs.

Figures 16, 18:
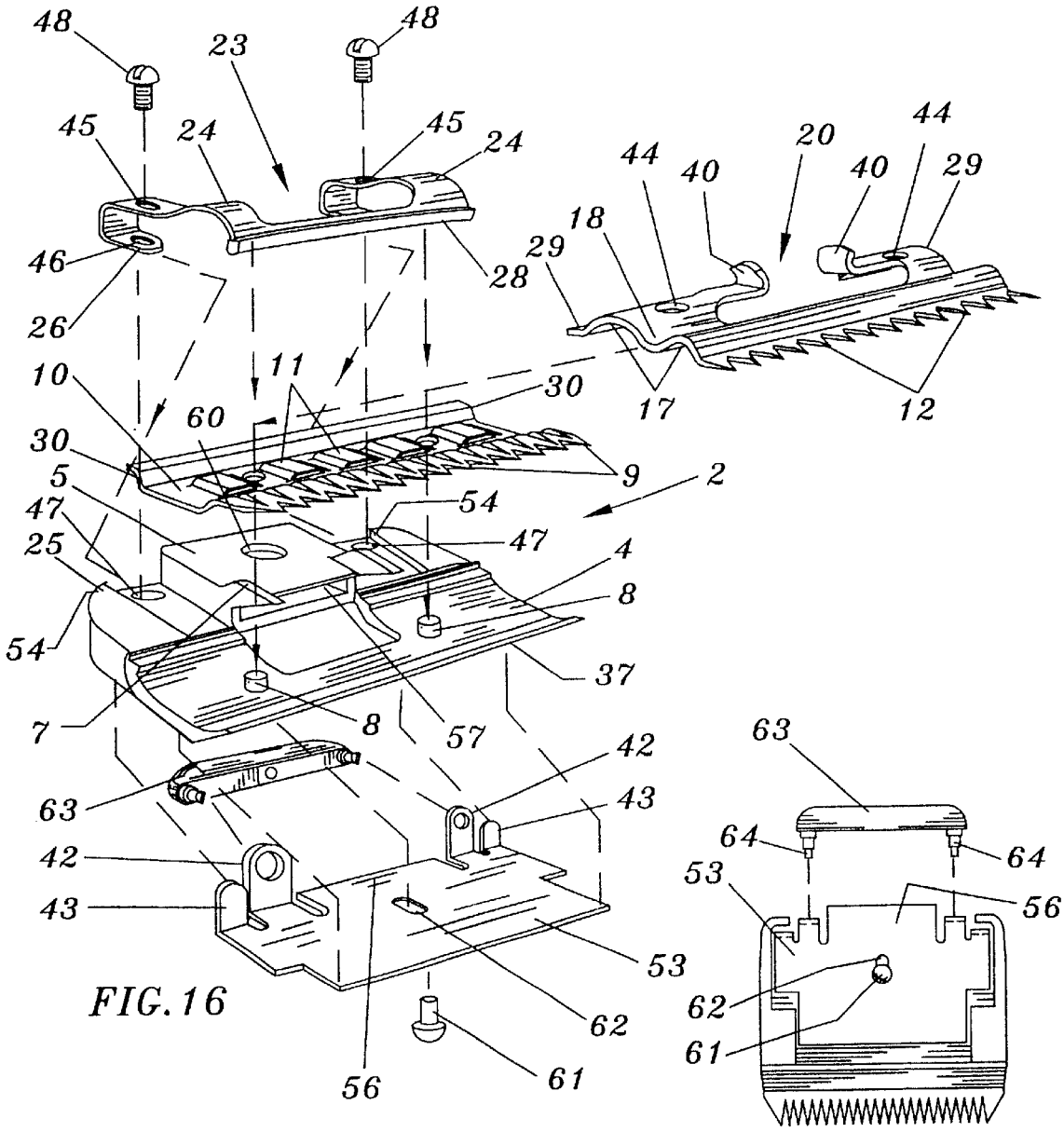
FIG. 16 illustrates a perspective view, exploded, of an alternate embodiment of the cutting head assembly for attachment of a comb element.
FIG. 18 illustrates a bottom plan view of the alternate cutting head with spring mounting apparatus.
Figure 19:
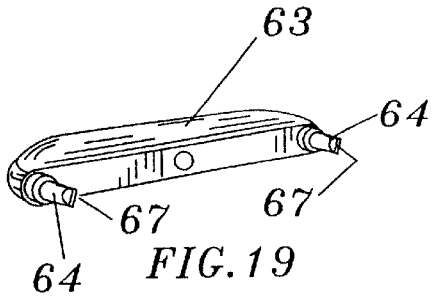
FIG. 19 illustrates a perspective view of the tool for use with the spring mounting apparatus.

A variation of this spring force attachment is illustrated in FIGS. 15 through 18. In this case a back plate (51) replaces the spring clip (35) and side elements (65) are added. This provides a structure for the comb element (32) when a thin comb made of plastic or similar material is desired. A rivet indentation (66) may be provided if clearance is required when the comb element (32) is mounted. The back plate (51) has a slot (52) therein into which plate (53) protrudes by extension (56). The plate (53) has spring tabs (43) which engage springs (50) placed in spring cavities (49). The back plate (51) may be tapered in the portion (68) above the slot (52) for ease of inserting the extension (56) into the slot (52). The plate (53) is attached to the base member (2) by means of a rivet (61), screw or the like passing through aperture (60) and sliding aperture (62). Pressure on push tabs (42) compresses the spring (50) as the plate (53) is pushed against the force of the spring (50). This moves extension (56) to allow comb element (32) to be removed from or mounted on the cutting head (1). When thus mounted the groove notch (34) will engage the front edge (36) of the cutting teeth and when the plate (53) is released the extension (56) will engage the slot (52). A tool (63) with posts (64) may be provided as illustrated in FIGS. 16 and 19 to aid in pushing push tabs (42). The tool (63) with posts (64) may also have a blade or hex head for use in adjusting the tension for screws (48).

Figure 19A:
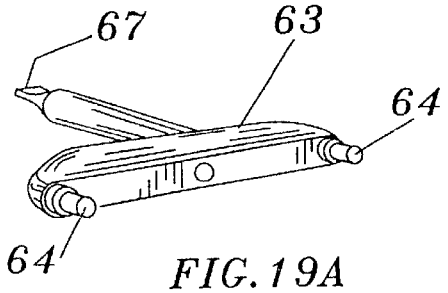
FIG. 19A illustrates a perspective view of an alternate form of the tool.
Figure 20:
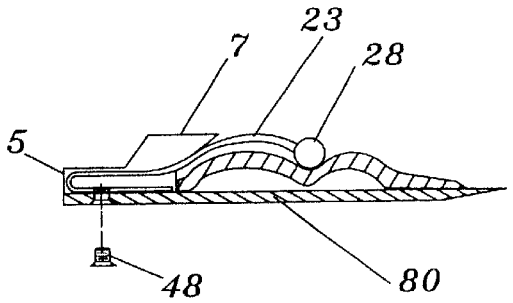
FIG. 20 illustrates a side elevation cross-section view of an alternate embodiment of the head assembly with base cutting blade.
Figure 21:
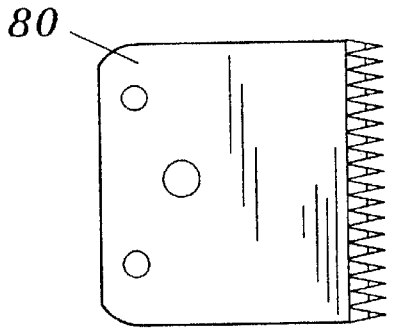
FIG. 21 illustrates a top plan view of the base cutting blade.
Figure 25:
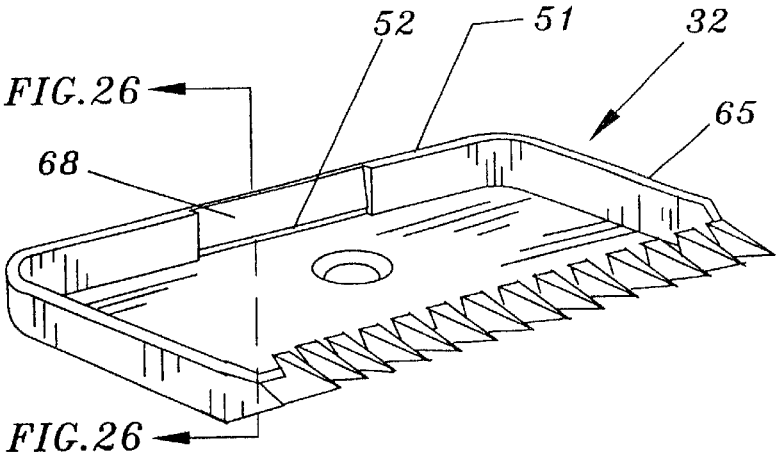
FIG. 25 illustrates a perspective view of the comb element with taper feature.
Figure 26:
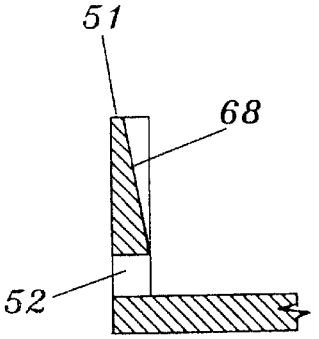
FIG. 26 illustrates a side elevation cross-section partial view of the comb element taper feature.
Figure 22:
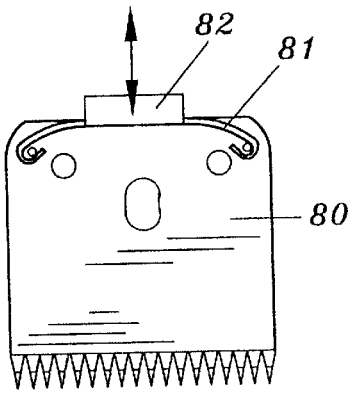
FIG. 22 illustrates a top plan view of an alternate embodiment of the base cutting edge.
Figure 23:
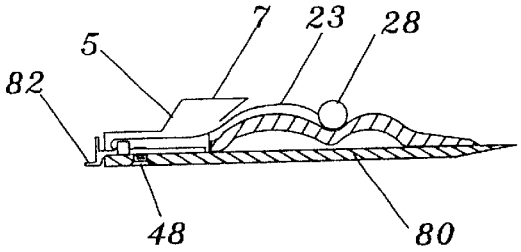
FIG. 23 illustrates a side elevation cross-section view of an alternate embodiment of the head assembly with base cutting blade.
Figure 24:
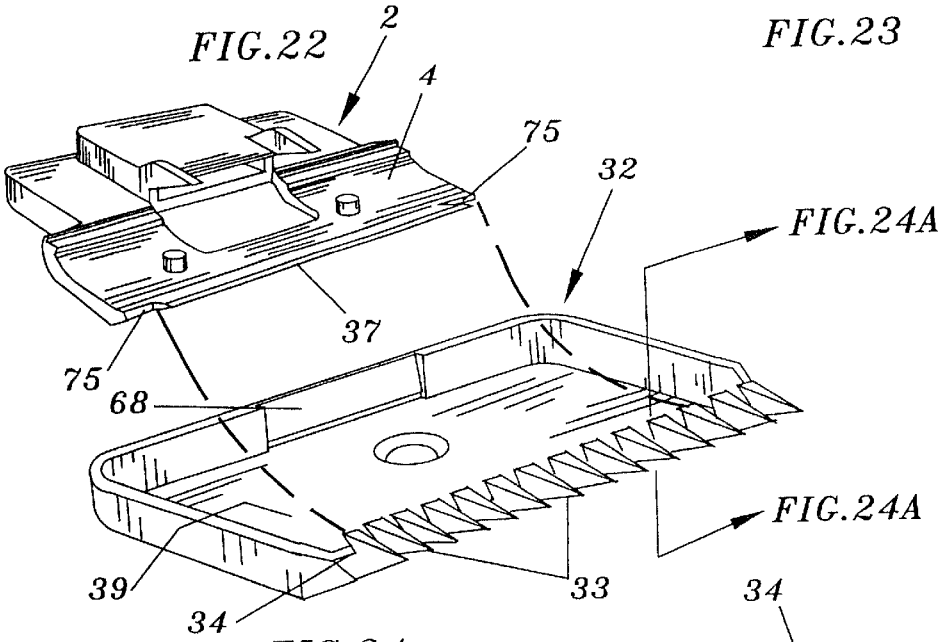
FIG. 24 illustrates a perspective view of the comb element and base member with tabs and notches.
Figure 24A:
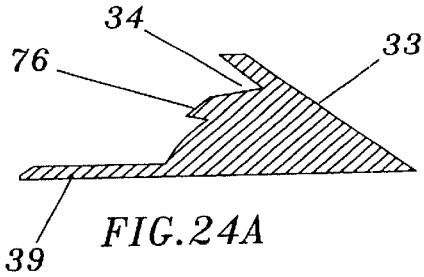
FIG. 24A illustrates a side elevation cross-section view of a comb element tooth.
Figure 27:
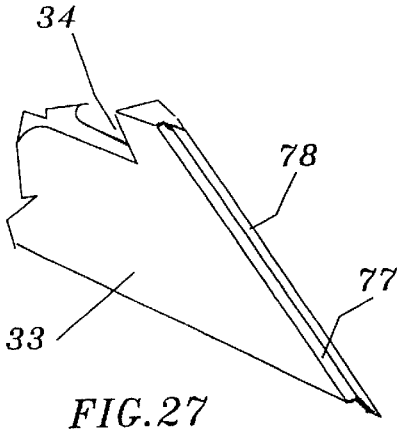
FIG. 27 illustrates a perspective view of a comb tooth.

An alternate configuration of the tool (63) is illustrated in FIG. 19A wherein posts (64) are round tipped and the blade or hex head (67) is located opposite the posts (64).

The base (2) may have a more exaggerated rounding of the corners (54) to aid the user in turning the clipper while cutting in confined areas such as animal limb joints and the like.

The base member (2) may also include protrusions (58) on the inside of attachment lugs (7) and in mounting cavity (57) which protrusions (58) are compressible. When the cutting head (1) is mounted to a clipper (6) a tongue is inserted in mounting cavity (57). The clipper tongues of various clippers (6) are not always of the same dimensions. The protrusions (58) accommodate a variety of sizes of tongues to reduce vibration from what otherwise would be a loose fit. The protrusions (58) on attachment lugs (7) serve a similar purpose when the cutting head (1) is attached to the clipper (6).

The base member (2) and lower cutting blade (9) may be replaced with a one piece base cutting blade (80). In this embodiment the upstanding central bridge (5) and other elements are attached and supported by the base cutting blade (80). The spring clip (23) is attached on the base cutting blade (80) and the plate (53) with springs and other elements is replaced by a leaf spring (81) having a spring extension (82) for engaging slot (52).

While the invention has been particularly shown and described with respect to the illustrated and preferred embodiments thereof, it will be understood by those skilled in the art that the foregoing and other changes in form and details may be made therein without departing from the spirit and scope of the invention.

I claim:

1. A disposable cutting head for use with clippers comprising:

a base member including a mounting portion having an upstanding central bridge, a means for removable interlocking engagement with a clipper and including a lower blade support portion forward of the mounting portion;

the lower blade support portion having a plurality of posts in a recessed portion extending the longitudinal length of the lower blade support portion;

a lower cutting blade having a plurality of lower teeth on a forward edge thereof and a recessed portion for assembly into the lower blade support portion with the lower cutting blade having a plurality of apertures defined therein to receive the posts;

the lower teeth formed with a plurality of indentations therein;

an upper cutting blade having a plurality of upper teeth on a forward edge thereof and a recessed portion including a groove formed therein extending the longitudinal length of the upper cutting blade, and further including means for driven engagement by the clipper;

the upper cutting blade being located opposed to and in contact with the lower cutting blade when the disposable cutting head is assembled wherein the upper cutting blade and the lower cutting blade are formed with a slightly concave shape one relative to the other along their longitudinal dimension parallel to the teeth;

a spring member attached by a means for attachment to the base member and supporting the upper cutting blade in assembled longitudinal sliding fashion relative to and against the lower cutting blade with a runner in the groove.

2. The disposable cutting head as in claim 1 wherein the upper teeth formed with a plurality of indentations therein.

3. The disposable cutting head as in claim 1 wherein the lower cutting blade having a plurality of ribs defined therein in the recessed portion.

4. The disposable cutting head as in claim 1 wherein the upper cutting blade means for driven engagement is a rear edge having an enlarged recess defined therein on two edges of which a pair of shoes are formed.

5. The disposable cutting head as in claim 4 wherein each shoe has a round edge at the contact surface with a clipper drive lug.

6. The disposable cutting head as in claim 1 wherein the lower cutting blade and the upper cutting blade are formed with the lower teeth and the upper teeth ragged edges formed during the manufacturing process to be oriented in the direction of the opposed lower cutting blade and the upper cutting blade when assembled.

7. The disposable cutting head as in claim 1 wherein the lower blade support portion at a support front edge thereof does not protrude under the lower teeth.

8. The disposable cutting head as in claim 1 wherein the spring member means for attachment comprising the base having a pair of apertures therein; the spring member having a pair of apertures therein in a pair of opposed arms upper portion and having a pair of threaded apertures therein in the opposed arms lower portion; and a pair of screws passing through the opposed arms upper portion and the base with the screws threadably engaged with the threaded apertures.

9. The disposable cutting head as in claim 1 wherein the spring member means for attachment comprising the base having a pair of attachment posts on the underside thereof and the spring member having a pair of apertures therein in a pair of opposed arms lower portion wherein the attachment posts pass through the apertures.

10. The disposable cutting head as in claim 1 wherein the base at a back edge having rounded corners.

11. The disposable cutting head as in claim 1 wherein there is a deflector plate attached to the spring member in position to partially cover a clipper cavity.

12. The disposable cutting head as in claim 1 wherein the upper cutting blade having a heat aperture formed therein.

13. The disposable cutting head as in claim 1 wherein the upper cutting blade having fixturing holes formed therein.

14. The disposable cutting head as in claim 1 wherein the base member having a pair of attachment lugs with a protrusion on each.

15. The disposable cutting head as in claim 1 wherein the base member having a mounting cavity with a plurality of protrusions therein.

16. The disposable cutting head as in claim 1 wherein:

the base member having a plate slidably engaged on a bottom thereof and the plate having an extension element rearward of the base member;

a cavity formed in the base member with a spring inserted therein;

the plate having a spring tab which engages the spring; and a means to press the plate against the force of the spring.

17. The disposable cutting head as in claim 16 wherein the means to press is a push tab attached to the plate.

18. The disposable cutting heads as in claim 17 wherein a tool is used to press the push tabs.

19. The disposable cutting head as in claim 16 wherein the means for slidable engagement is the plate having a slide aperture therein and a rivet attaches the plate through the slide aperture to the base element.

20. A device for mounting an upper cutting blade and a lower cutting blade with a spring member comprising:

a base member with a mounting portion having an upstanding bridge;

a lower blade support portion forward of the mounting portion; and a means for removable interlocking engagement with a clipper.

21. The device as in claim 20 wherein the means for removable interlocking is the upstanding bridge having a mounting cavity therein and a pair of attachment lugs.

22. The device as in claim 21 wherein each attachment lug having a protrusion on the inside surface thereof.

23. The device as in claim 21 wherein the mounting cavity having a plurality of protrusion therein.

24. A disposable cutting head for use with clippers comprising:

a base cutting blade having an upstanding central bridge attached and a means for removable interlocking engagement with a clipper;

the base cutting blade having a plurality of lower teeth on a forward edge thereof;

the lower teeth formed with a plurality of indentations therein;

an upper cutting blade having a plurality of upper teeth on a forward edge thereof and a recessed portion including a groove formed therein extending the longitudinal length of the upper cutting blade, and further including means for driven engagement by the clipper;

the upper cutting blade being located opposed to and in contact with the base cutting blade when the disposable cutting head is assembled wherein the upper cutting blade and the base cutting blade are formed with a slightly concave shape one relative to the other along their longitudinal dimension parallel to the teeth;

a spring member attached by a means for attachment to the base cutting blade and supporting the upper cutting blade in assembled longitudinal sliding fashion relative to and against the base cutting blade with a runner in the groove.

25. The disposable cutting head as in claim 24 wherein the upper cutting teeth formed with a plurality of indentations therein.

26. The disposable cutting head as in claim 24 wherein there is a comb element means for attachment.

* * * * *